US006179464B1

(12) United States Patent
Bettelini

(10) Patent No.: US 6,179,464 B1
(45) Date of Patent: Jan. 30, 2001

(54) DISCONNECTING-GEAR DEVICE FOR A TIMEPIECE GEAR TRAIN

(75) Inventor: Marco Bettelini, Prêles (CH)

(73) Assignee: ET SA Fabriques D'Ebauches, Grenchen (CH)

( * ) Notice: Under 35 U.S.C. 154(b), the term of this patent shall be extended for 0 days.

(21) Appl. No.: 09/094,108

(22) Filed: Jun. 10, 1998

(30) Foreign Application Priority Data

Jun. 12, 1997 (CH) ..... 1426/97

(51) Int. Cl.[7] ..... G04B 18/00
(52) U.S. Cl. ..... 368/185; 368/193; 368/192
(58) Field of Search ..... 368/145, 146, 368/190, 195, 308, 319

(56) References Cited

U.S. PATENT DOCUMENTS 3,972,177 8/1976 Vuilleumier .
4,262,354 * 4/1981 Sakamoto ..... 368/185
4,363,554 * 12/1982 Schaffner et al. ..... 368/190
4,555,185 * 11/1985 Vuilleumier ..... 368/190
4,862,434 * 8/1989 Hiraga et al. ..... 368/190

FOREIGN PATENT DOCUMENTS 8103 1/1894 (CH) .
15953/64 9/1966 (CH) .

* cited by examiner

*Primary Examiner*—Bernard Roskoski
(74) *Attorney, Agent, or Firm*—Sughrue, Mion, Zinn, Macpeak & Seas, PLLC

(57) ABSTRACT

The gear train (1) connecting the driving element (3) to the minute wheel (2) includes a wheel and pinion (5) able to be disconnected from this train to interrupt the movement and stop the hour (23) and minute (22) display when the time-setting stem (8) is actuated while in a pulled out position (21). The disconnectable wheel and pinion (5) then undergoes a movement of translation which removes it from the other wheels and pinions (4, 6) of the train (1), the axes about which all the wheel and pinions rotate remaining substantially parallel to each other.

8 Claims, 5 Drawing Sheets

DISCONNECTING-GEAR DEVICE FOR A TIMEPIECE GEAR TRAIN

BACKGROUND OF THE INVENTION

The invention relates to a disconnecting-gear device for a timepiece gear train, this gear train actuating a minute wheel from a driving member and including a plurality of wheels and pinions arranged in a chain and meshing with each other, this chain including a wheel and pinion able to be disconnected from one of the other wheel and pinions by the action of a lever controlled by a time-setting stem to interrupt the chain and stop the minute wheel.

A disconnecting-gear device answering the generic definition of the above paragraph is known. A description thereof is given, for example, in document EP-B-O 261 243 (=U.S. Pat. No. 4 862 434).

In this document, the disconnecting-gear device is also disposed between a driving element and a minute wheel. It is a wheel and pinion able to be disconnected from the minute wheel, this wheel and pinion being the wheel following the centre-wheel, known in French by the name of <<roue moyenne>>, hereinafter the <<third wheel>>, but in reality including a wheel and a pinion with a common shaft. The wheel is meshed with a second centre-pinion, whereas the pinion is meshed with the minute wheel. One of the pivots of this wheel and pinion, which will be called the third pivot, rotates in a drill hole made in a bridge, whereas the other pivot rotates in a drill hole made in a lever controlled by a time-setting stem. When the time-setting stem is pulled out, the shaft of the third wheel and pinion inclines in such a way that its pinion leaves the toothing of the minute wheel. The hour and minute display is thus stopped, the hands being then able to be set by manipulating the stem via the motion-work.

This disconnecting-gear device has the drawback of increasing the thickness of the timepiece, since it is clear that space must be provided for the third wheel in the inclined state. On the other hand, since the pinion of the third wheel meshes directly with the minute wheel, it is also clear that during a gear reconnecting the minute hand can lead to a display error, the significance of this error depending upon the position of the pinion toothing with respect to the wheel toothing at the moment of gear reconnection. If the wheel has 60 teeth, the error may be as much as plus or minus a half minute. This error may be calculated by the following formula where E is the error and n is the number of teeth of the minute wheel:

$$E = \pm \frac{1}{2} \cdot \frac{360^\circ}{n}$$

In the case wherein n=60, E=±3°=approximately±½ minute.

SUMMARY OF THE INVENTION

In order to overcome the drawbacks indicated hereinbefore, in addition to satisfying the preliminary description given in the first paragraph of the description, the present invention is characterised in that, when actuated, the disconnectable wheel and pinion undergoes a movement of translation with respect to the other wheels and pinions, the axes about which all the wheels and pinions rotate remaining substantially parallel to each other.

A disconnectable wheel and pinion undergoing a movement of translation with respect to the other wheels and pinions when it is actuated, is shown in document CH-A-15 953/64. This document discloses a watch including a driving element, in this case a click, transmitting the movement of an oscillator to the second wheel. The driving element and the time-setting device are arranged in such a way that when the time-setting device is brought into the active position, it causes the movement of a rocking bar carrying an intermediate wheel and pinion between a wheel actuated by the driving element and the second wheel. Moreover, in this design, the second wheel remains constantly coupled to the minute and hour hand gear train.

The design which has just been briefly described fundamentally differs from that of the present invention. It will first be noted that the rocking bar is inserted in a kinematic chain controlling the second wheel, this latter always remaining meshed with the gear train of the minute and hour hands, whereas in the present invention, the rocking bar is inserted in a kinematic chain controlling the minute wheel, the second wheel remaining permanently coupled to the driving element. It will also be noted that, in the cited document, the intermediate wheel and pinion is uncoupled from the two wheels between which it is situated, and not only, as will be seen in the present invention, from only one of the two wheels. Finally, it will be observed that interrupting a kinematic second chain, as proposed by the cited document, may lead to losing or gaining a second according to the position in which the different wheels are situated at the moment of gear reconnection. It will be seen that in the present invention, the second wheel always remains in phase with the driving element since the kinematic second chain is never interrupted.

The present invention will now be described in detail on the basis of an embodiment given by way of example and illustrated by the drawings, in which:

DESCRIPTION OF A PREFERRED EMBODIMENT

Figure 1:
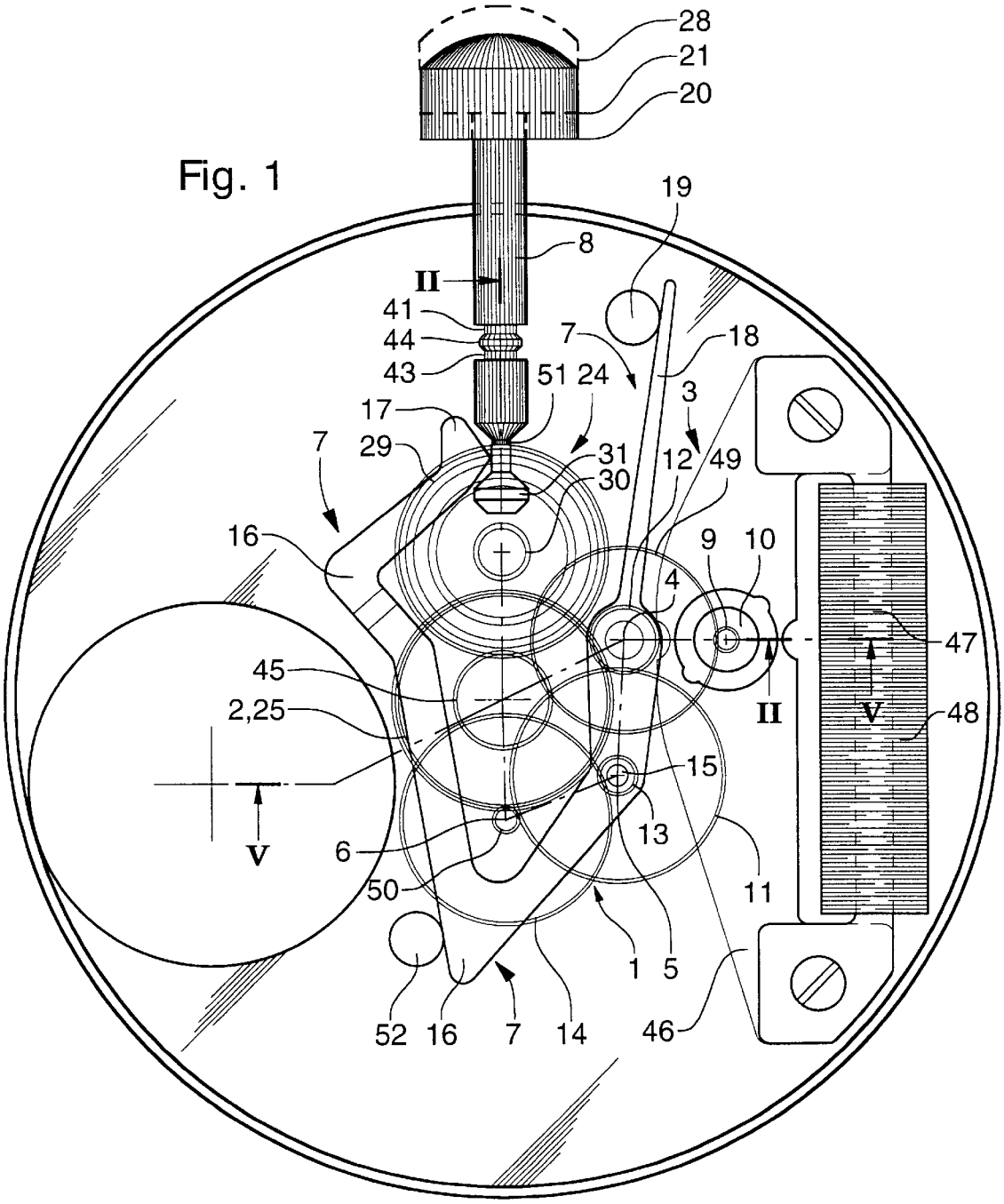
FIG. 1 is a plane view of the device of the invention, shown with the stem pushed in the neutral position, the hour and minute hands being driven by a motor and uncoupled from the time-setting stem.
Figure 2:
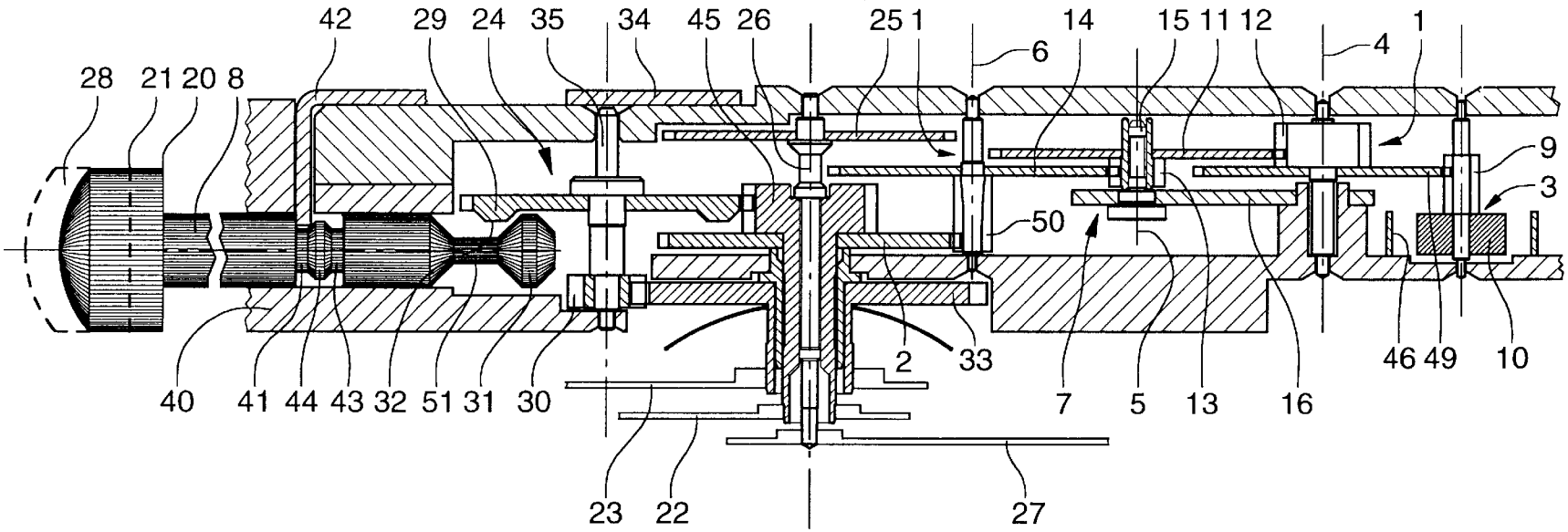
FIG. 2 is a cross-section along the line II—II of FIG. 1.
Figure 3:
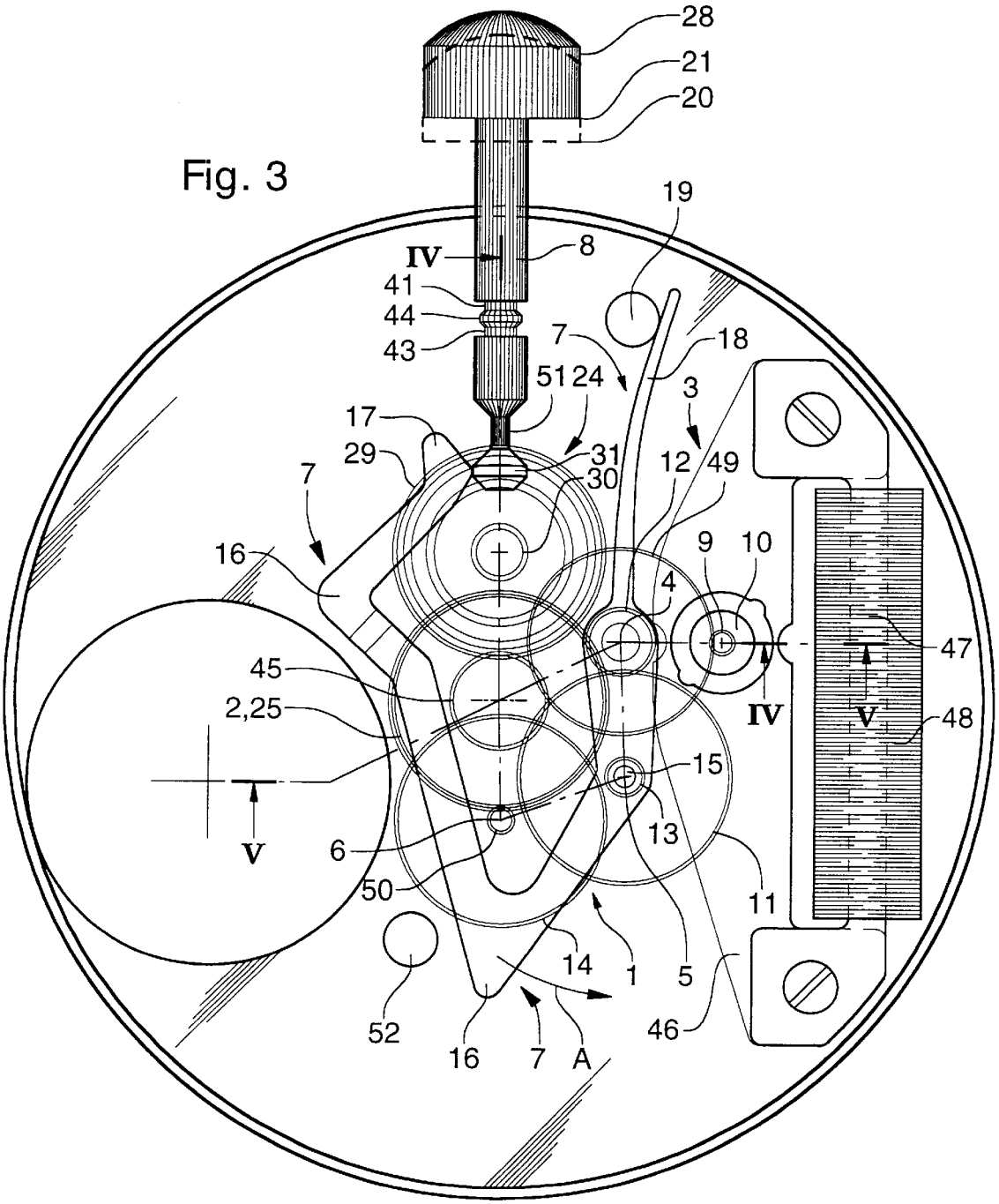
FIG. 3 is a plane view of the device of the invention, shown with the stem in the pulled out position, the hour and minute hands being driven by the time-setting stem and uncoupled from the motor.
Figure 4:
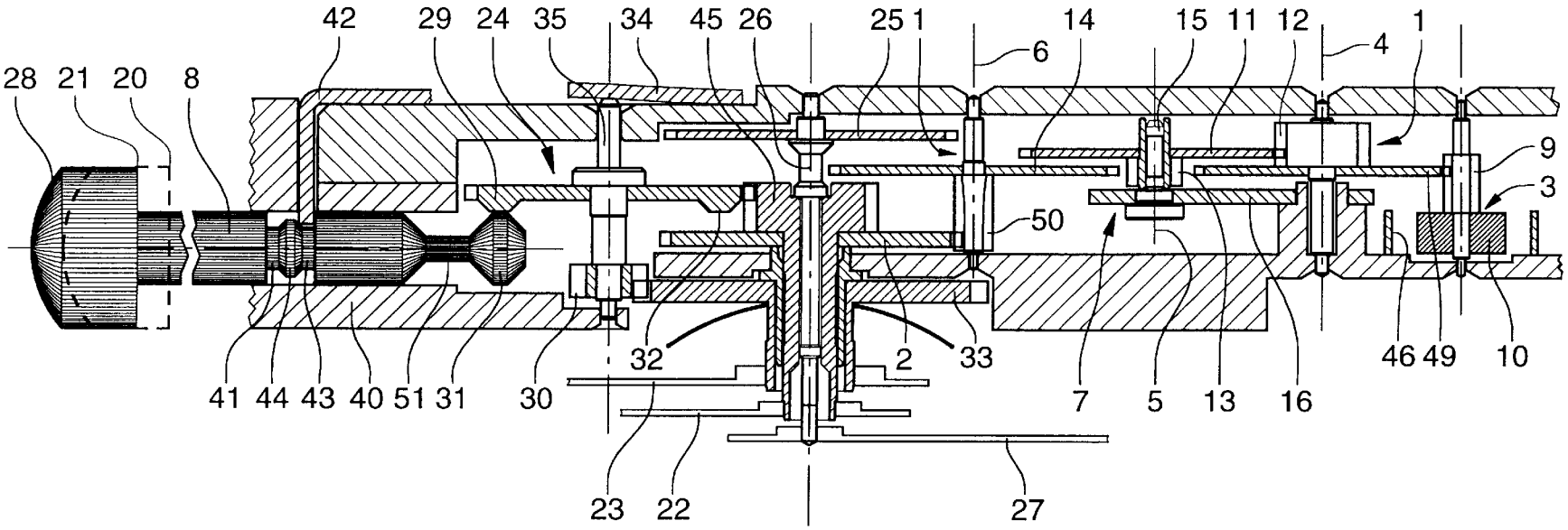
FIG. 4 is a cross-section along the line IV—IV of FIG. 3.

FIGS. 1 to 4 show how the timepiece time-setting device is made. This device includes a time-setting stem 8. This stem is topped at one of its ends by a crown 28 which allows the stem to be manipulated by fingers. The stem may be set in a first pushed in neutral position 20 as is shown in FIGS. 1 and 2. In this neutral position, the stem has no action on the motion work 24 of the timepiece. If it is driven in rotation, it thus runs idle. From this pushed in position, stem 8 may be pulled out to occupy the position illustrated by FIGS. 3 and 4. In this pulled out position 21, stem 8 co-operates with a motion work 24 including a wheel 29 and a pinion 30 attached to a shaft 35 to allow time-setting of the hour 23 and minute 22 hands. FIGS. 2 and 4 show particularly well that the end of stem 8 opposite the end topped by crown 28 is arranged to rest upon a peripheral zone 32 of motion work wheel 29 when stem 8 is pulled out in second position 21. At this moment, motion work wheel 29 may be driven by friction by stem 8 when this stem is actuated in rotation.

It will be understood that in the pulled out or time-setting position of stem 8, it is indispensable to disconnect hour and minute hands 23 and 22 from motor 3 which normally drives them to display the time.

FIGS. 1 to 4 show such a disconnecting device inserted in a timepiece gear train 1, this train driving a minute wheel 2 from a driving element 3. The Figures show that gear train 1 includes a plurality of wheels and pinions 4, 5 and 6 disposed in a chain and meshing with each other. This chain includes a wheel and pinion 5 able to be disconnected from at least one of the other wheels and pinions (from wheel and pinion 6 in the embodiment illustrated in the Figures) via the action of a lever 7 controlled by time-setting stem 8 to interrupt the chain and stop minute wheel 2. FIGS. 2 and 4 show disconnectable wheel and pinion 5 respectively connected to and disconnected from gear train 1. It is important to note here that disconnectable wheel and pinion 5, when it is actuated by lever 7, undergoes a movement of translation with respect to the other wheels and pinions 4 and 6. Indeed, the axes about which all wheels and pinions 4 and 6 rotate remain substantially parallel to each other.

An embodiment first of the time-setting device including the time-setting stem and the motion work associated therewith, then the disconnecting device inserted in the gear train connecting the motor to the hour and minute display will now be described in detail.

The Time-setting Device

FIGS. 1 to 4 show that the timepiece is fitted with a stem 8 topped by a crown 28 which facilitates manipulation of the stem. This stem may be disposed in a first pushed in position 20 (FIGS. 1 and 2) or in a second pulled out position 21 (FIGS. 3 and 4). Stem 8 is guided into a plate 40 and has a first groove 41 in which a positioning spring 42 engages when said stem is in its first pushed in position, and a second groove 43 in which the same spring 42 engages when the stem is in its second pulled out position. Grooves 41 and 43 are separated by a flange 44.

The other end of stem 8, that opposite to crown 28, has a knob 31. Reference 24 designates the motion work which includes a shaft 35, a wheel 29 and a pinion 30. In a peripheral zone of motion work wheel 29 and more precisely under the latter, there is an annular flange 32 on which knob 31 of stem 8 rests when this stem is in its second pulled out position (FIG. 4). Thus, in this pulled out configuration, when stem 8 is actuated in rotation, knob 32 is driven by friction and with it the whole motion work 24. Since motion work wheel 29 meshes with a cannon-pinion 45 which carries, in addition to a minute wheel 2, a minute hand 22 and since the motion work pinion 30 meshes with a cannon wheel 33 carrying an hour hand 23, it is understood that when stem 8 is actuated in rotation, wheel 29 and pinion 30 are driven which in turn drive respectively minute hand 22 and hour hand 23, which allows time-setting thereof.

In the pushed in neutral position (FIG. 2), knob 31 is released from flange 32 as well as from motion work wheel 29 which it does not touch. In this pushed in position, the stem thus runs idle if it is driven in rotation.

As was indicated hereinbefore, in order to drive wheel 29 from knob 31 a pressure must be exerted on the wheel for flange 32 to be driven by knob 31. This may be achieved by raising wheel 29 when stem 8 is pulled into the second position. As a matter of fact, when one passes from the situation shown in FIG. 2 (stem pushed in) to the situation shown in FIG. 4 (stem pulled out), knob 31 raises wheel 29 against the return force of a spring 34 which, in this embodiment example, pushes on shaft 35 of motion work 24. Good contact is then assured between flange 32 and knob 31. It is to be observed that when being raised, wheel 29 and pinion 30 always remain meshed with cannon-pinion 45 and cannon-wheel 33 respectively.

Good contact between the knob and flange is not limited to the example which has just been described. For example, the return spring could be controlled by the stem at the moment when it is pulled out. This spring would then push on the shaft to prevent it from being raised, the wheel always remaining in a same plane.

It should be noted here that fitting an annular flange, made on wheel of a motion work, with teeth, this toothed flange meshing with a knob which is also toothed has already been proposed. Such an embodiment is very expensive due to cutting of the teeth and would thus not be suitable for an inexpensive timepiece.

The time-setting device which has just been described differs from the aforecited document EP-B-0 261 243, first in that it does not include any contrate pinions, then in that it does not require extreme precision to drive by friction two parts co-operating with each other.

As is seen particularly well in the plane views of FIGS. 1 and 3, when stem 8 is disposed in second pulled out position 21, knob 31 actuates a lever 7 which interrupts the time movement of hour hand 23 and minute hand 22 by uncoupling or disconnecting a wheel and pinion 5 inserted in a gear train 1 connecting motor 3 to minute wheel 22 of the timepiece. This disconnecting device will now be described in detail.

The Disconnecting Device

As was seen hereinbefore and as FIGS. 1 to 4 clearly show, the disconnecting device includes a wheel and pinion 5 able to be disconnected from a gear train 1 including a plurality of wheels and pinions 4 to 6 arranged in chains, this wheel and pinion 5, when it is actuated by a lever 7 controlled by time-setting stem 8, undergoing a movement of translation with respect to the other wheels and pinions 4 and 6, the axes of all the wheels and pinions remaining substantially parallel to each other.

Gear train 1 in question here connects a motor 3 activated by time pulses to a minute wheel 2 which carries the minute hand 22. Motor 3 is preferably of the stepping type including a stator 46, a core 47 surrounded by a coil 48 and a magnetised rotor 10 whose shaft carries a pinion 9. As is seen in FIGS. 1 to 4, gear train 1 includes first an intermediate wheel and pinion 4 meshed with pinion 9 carried by rotor 10 of motor 3, then disconnectable wheel and pinion 5 meshed with said intermediate wheel and pinion 4 and a third wheel and pinion 6 meshed with said disconnectable wheel and pinion 5, this third wheel and pinion being meshed with minute wheel 2.

More precisely, intermediate wheel and pinion 4 includes a wheel 49 meshing with pinion 9 of rotor 10 and a pinion 12 meshing with a wheel 11 carried by disconnectable wheel and pinion 5. The disconnectable wheel and pinion also includes a pinion 13 meshed with a third wheel 14 carried by third wheel and pinion 6, said third wheel and pinion 6 also carrying a pinion 50 which meshes with minute wheel 2.

Moreover, as FIGS. 2 and 4 show, disconnectable wheel and pinion 5 is mounted so as to pivot on a stud 15 which is attached to lever 7 controlled by stem 8.

If FIGS. 1 and 3 are examined closely, lever 7 controlled by stem 8 is a strip 16 mounted so as to pivot on the shaft about which intermediate wheel and pinion 4 rotates. The end 17 of this lever 7 is turned up like a nose in order to co-operate with stem 8 or more precisely with knob 31 of said stem. The other end 18 of this same lever 7 has a thin part to form an elastic portion which rests on a nib 19.

Thus, as all the parts present have been described, the manner in which the disconnecting device operates can now be explained.

When time-setting stem 8 is set in its first pushed in neutral position 20 (FIGS. 1 and 2), end 17 of lever 7 is engaged in a groove 51 which follows knob 31 of the stem. Strip 16 of lever 7 then rests against a nib 52, biaised by elastic portion 18 of lever 7. In this situation, disconnectable wheel and pinion 5 is meshed both with intermediate wheel and pinion 4 and third wheel and pinion 6. Motor 3 then actuates hour hand 23 and minute hand 22 of the timepiece.

When stem 8 is arranged in its second pulled out position 21 (FIGS. 3 and 4), end 17 of lever 7 mounts knob 31 of the stem and causes strip 16 to pivot in the direction of arrow A about the shaft supporting intermediate wheel and pinion 4, while bending elastic portion 18 of lever 7. In this configuration, disconnectable wheel and pinion 5 becomes disconnected from third wheel and pinion 6—more precisely pinion 13 of disconnectable wheel and pinion 5 becomes disconnected from third wheel 14—while wheel 11 thereof remains meshed with pinion 12 of intermediate wheel and pinion 4. Thus train 1 includes a wheel and pinion able to be disconnected from at least one of the other wheel and pinions, but it will be understood that another arrangement could cause the disconnectable wheel and pinion to be disconnected from each of the neighbouring wheel and pinions. Then, hour 23 and minute 22 hands are stopped which allows stem 8 to co-operate with the motion work to proceed to the time-setting of the hands.

The aforecited document EP-B-O 261 243 also discloses a disconnecting device which is made by inclining the third wheel. Not only does this mechanism take up a lot of space in height, it can, during re-engaging, lead to an error of plus or minus a half minute on the minute hand display. Conversely, the disconnecting device described hereinbefore does not take any space in height since there is only translation of one wheel and pinion. Moreover, the disconnected wheel and pinion is not the third wheel, but a wheel and pinion situated upstream, which reduces by at least ten times the display error during re-connecting.

If E is the maximum error, n is the number of teeth of minute wheel 2, n' the number of teeth of pinion 50, and n" the number of teeth of third wheel 14:

$$E \cong \pm \frac{1}{2} \cdot \frac{360°}{n''} \cdot \frac{n'}{n}$$

In the case wherein n=70, n'=7 and n"=60, the maximum error is E=±0,3° i.e. 3 seconds only.

Driving the Second Hand

Figure 5:
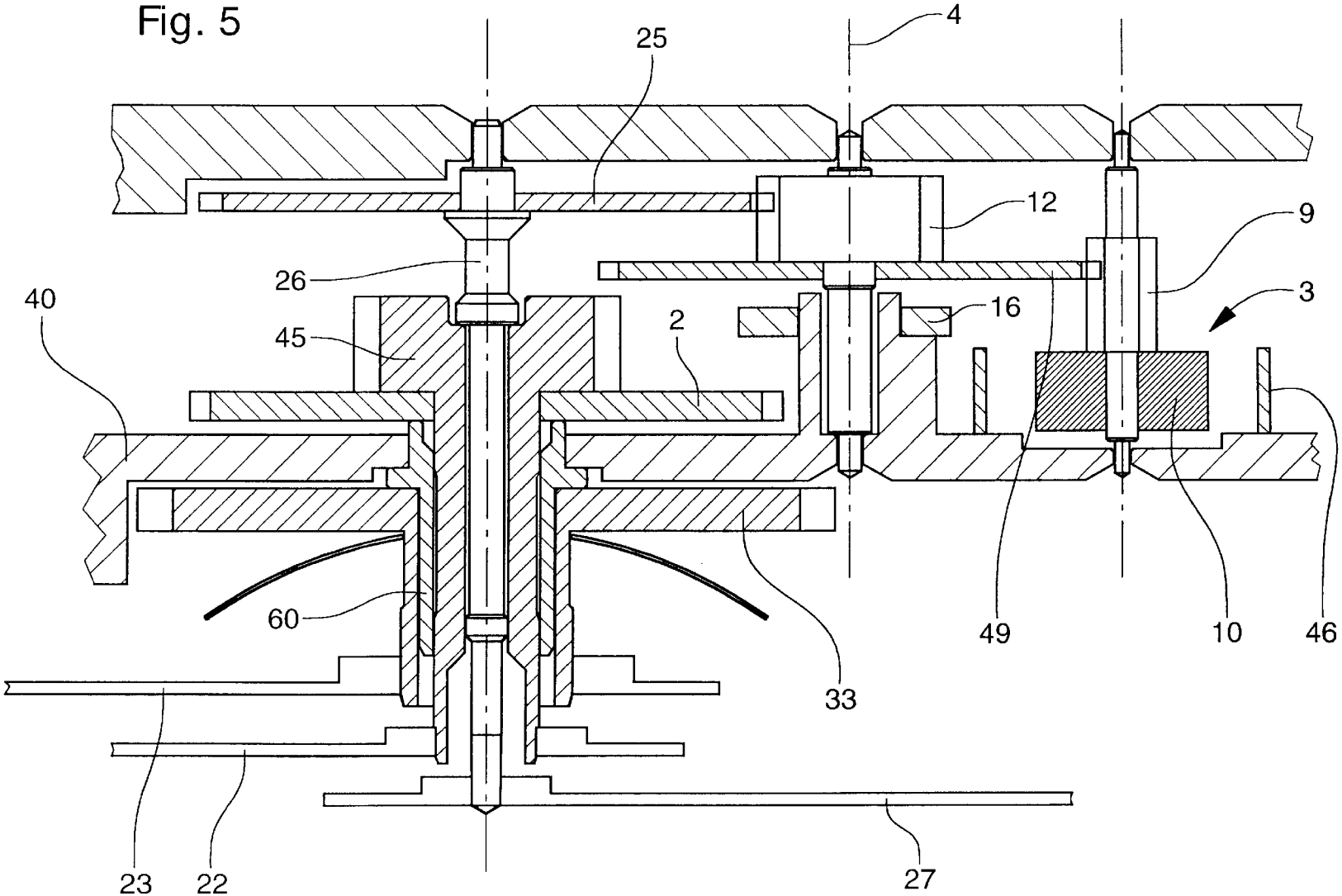
FIG. 5 is a across-section along the line V—V of FIGS. 1 and 3.

The movement described hereinbefore provides a second display. As is shown in FIG. 5, pinion 9 which is situated on magnet 10 of motor 3 meshes with wheel 49 of intermediate wheel and pinion 4 as was already seen hereinbefore for driving gear train 1. In addition to wheel 11 of disconnectable wheel and pinion 5 (FIGS. 1 to 4), a second wheel 25, which drives by its shaft 26 a second hand 27, also meshes with pinion 12 of intermediate wheel 4. Cannon-pinion 45 passes through a central tube 60, driven into plate 40, which is topped by cannon wheel 33. At the moment of time-setting of minute hand 22 and hour hand 23, second hand 27 continues to display the seconds. As an alternative, this hand could be stopped electrically if a switch is installed on the stem.

What is claimed is:

1. A disconnecting-gear device for a timepiece gear train, said device including a minute wheel driven by a driving element via a plurality of wheels and pinions arranged in a chain and meshing with each other, said chain including a displaceable wheel and pinion capable of being disconnected from one of the other wheels and pinions in the chain, a movable lever, an axially displaceable time-setting stem for moving the lever to disconnect the displaceable wheel and pinion to attendantly interrupt the chain and stop the minute wheel, said displaceable wheel and pinion undergoing a movement of translation with respect to said other wheels and pinions when it is disconnected, and the axes about which all said wheels and pinions rotate remaining substantially parallel to each other.

2. A disconnecting-gear device according to claim 1, wherein the gear train includes in succession: an intermediate wheel and pinion meshed with a pinion carried by a rotor of a motor comprising the driving element, the displaceable wheel and pinion meshed with said intermediate wheel and pinion, and a third wheel and pinion meshed with said displaceable wheel and pinion, said third wheel and pinion meshing with the minute wheel.

3. A disconnecting-gear device according to claim 2, wherein the displaceable wheel and pinion includes a wheel meshed with a pinion carried by the intermediate wheel and pinion, and a pinion meshed with a wheel carried by the third wheel and pinion, wherein said displaceable wheel and pinion is mounted to pivot on a stud fixed onto the lever moved by the time-setting stem.

4. A disconnecting-gear device according to claim 3, wherein the lever moved by the time-setting stem is a strip mounted to pivot on the shaft about which the intermediate wheel and pinion rotates, a first end of said lever cooperating with the time-setting stem and a second end of said lever having an elastic portion resting on a nib.

5. A disconnecting-gear device according to claim 4, wherein the time-setting stem is topped by a crown, and is displaceable between a first, neutral, pushed in position in which the displaceable wheel and pinion is meshed both with the intermediate wheel and pinion and the third wheel and pinion, with the motor actuating hour and minute hands of the timepiece, and a second, pulled out position in which the displaceable wheel and pinion remains meshed with the intermediate wheel and pinion and disconnected from the third wheel and pinion, the hour and minute hands then being stopped.

6. A disconnecting-gear device according to claim 5, wherein in the second, pulled out position the time-setting stem co-operate with a motion-work of the timepiece to allowing setting of the hour and minute hands.

7. A disconnecting-gear device according to claim 3, wherein the pinion of the intermediate wheel and pinion is also meshed with a second wheel of the timepiece carrying a second hand on a shaft thereof.

8. The disconnecting-gear device according to claim 1, wherein the disconnecting-gear device is located between said minute wheel and said driving element.

* * * * *